US005186250A

United States Patent [19]

Ouchi et al.

[11] Patent Number: 5,186,250

[45] Date of Patent: Feb. 16, 1993

[54] TUBE FOR HEAT EXCHANGERS AND A METHOD FOR MANUFACTURING THE TUBE

[75] Inventors: Wataru Ouchi, Shimodateshi; Katsuhisa Suzuki, Utsunomiyashi; Toshinori Tokutake, Oyamashi; Hirosaburo Hirano, Utsunomiyashi, all of Japan

[73] Assignee: Showa Aluminum Kabushiki Kaisha, Japan

[21] Appl. No.: 693,955

[22] Filed: Apr. 29, 1991

[30] Foreign Application Priority Data

May 11, 1990 [JP] Japan ..... 2-1222289
Jul. 27, 1990 [JP] Japan ..... 2-200206

[51] Int. Cl.[5] ..... F28F 1/06

[52] U.S. Cl. ..... 165/177; 165/152; 165/183

[58] Field of Search ..... 165/152, 177, 183; 29/890.049, 890.053

[56] References Cited

U.S. PATENT DOCUMENTS

| | | | |
|---|---|---|---|
| 349,060 | 9/1886 | Serve | 29/890.049 |
| 1,215,793 | 2/1917 | Gabrielson | 165/152 |
| 1,302,627 | 5/1919 | Boblett | 165/152 |
| 1,316,199 | 9/1919 | Spery | 165/152 |
| 2,093,256 | 9/1937 | Still | 165/152 |
| 2,151,540 | 3/1939 | Varga | 29/890.049 |
| 3,757,856 | 9/1973 | Kun | 165/166 |
| 4,825,941 | 5/1989 | Hoshino et al. | 165/110 |

FOREIGN PATENT DOCUMENTS 62-207572 9/1987 Japan .

*Primary Examiner*—Allen J. Flanigan

[57] ABSTRACT

A tube for heat exchangers is a flat tube which either comprises a pair of plane walls which are spaced a predetermined distance from one another, the plane walls respectively having lateral ends integrally connected to each other by a U-shaped bent portion, the plane walls further having other lateral ends which abut against and are tightly secured to one another, or alternatively, the flat tube comprises a pair of preformed plates having abutted and soldered portions at both lateral ends. The tube further comprises one or more curved lugs integral with and protruding inwardly from an inner surface of each plane wall, and the curve lugs respectively have innermost tops so that the innermost tops protruding from one plane wall bear against the inner surface of the other plane wall or against the innermost tops of the other curved lugs protruding from said other plane wall. Th tube is thus of an improved pressure resistance despite its minimized height or thickness, and the manufacturing process of the tube permits the production of tubes at a high productivity and lower manufacturing cost.

12 Claims, 7 Drawing Sheets

TUBE FOR HEAT EXCHANGERS AND A METHOD FOR MANUFACTURING THE TUBE

BACKGROUND OF THE INVENTION

1. Field of the Invention

The invention relates to a tube for heat exchangers and a method for manufacturing the tube, more particularly, the tube being of a flat or depressed shape adapted to compose the multiflow heat exchangers which are used as condensers in car cooler systems.

2. Description of Prior Art

The condensers in car cooling systems have generally been heat exchangers of the so-called serpentine-tube type. The principal parts of such prior art heat exchangers comprise a "harmonica" tube and fins combined therewith, this tube being a flat extruded tube having internal and longitudinal openings and being bent zigzag several times to thereby form portions parallel with one another, with each fin being disposed between those portions.

Another kind of prior art heat exchanger is called a "multiflow" type, and has recently been proposed and employed to reduce the flow resistance of coolant, to improve the heat transfer efficiency, to reduce the weight and the volume of the condenser. The multiflow type heat exchanger comprises, for example as shown in FIG. 13, a pair of right and left headers 31 and 32 made of a metal pipe. A plurality of flat tubes 33 are connected at their ends to the headers in fluid communication therewith. Fins 34 are each interposed between two adjacent tubes 33 and 33. Partitioning members 35 are each secured inside the headers 31 and 32 at suitable positions intermediate of their ends so that internal spaces of the headers are divided into compartments. Thus, a coolant passage of a zigzag pattern is formed to start from a coolant inlet 36 at an upper end of one header 31 and then to terminate at a coolant outlet 37 at a lower end of the other header 32 (as disclosed, for example, in the U.S. Pat. No. 4,825,941).

The abovementioned tubes 33 in the multiflow type heat exchangers have in general been certain flat or depressed aluminum tubes which are produced by the extrusion forming method and comprise longitudinally extending flow paths, because the tubes must withstand the high pressure of the compressed gaseous coolant employed in the heat exchanger. As shown in FIG. 14, each of those tubes has a peripheral wall 33*a* which is in the shape of ellipse in cross section. Each tube has also one or more longitudinal partitions 33*b* to divide the internal space into separate coolant paths 33*c*.

However, in all cases wherein the extruded tubes 33 are employed, their height "H" which is restricted by the manufacturing process, preventing the heat transfer efficiency from being raised above a certain upper limit. As will be understood, higher efficiency of heat transfer within a heat exchanger may be achieved effectively by minimizing the flow resistance of air which flows through the core of a given contour dimension, and at the same time, by increasing the core's overall surface in contact with the air flow. In other words, the extruded tubes 33 of a height "H" which has not been lowered to a sufficient degree have caused an increase in the air flow resistance and placed restrictions on the number of tubes installed within each core of a given contour dimension, thus failing to increase the core's surface area in contact with the air flow.

Seam-welded pipes have been proposed for use as the tubes in order to eliminate such a drawback (for example, see the Japanese Patent Publication 62-207572). The wall of seam-welded tubes can be reduced to a thickness of about 0.4 to 0.5 mm, remarkably decreasing the tube's height to about 1.5 to 1.7 mm.

Such an extremely thin wall per se of the seam-welded tubes cannot withstand the high pressure gaseous coolant which is supplied from a compressor to the tubes of the condensers. To resolve this problem, the prior art as disclosed on said Patent Publication 62-207572 makes use of an inner fin member inserted into each flat seam-welded tube. Those inner fin members which are previously corrugated in transverse direction before insertion are each soldered to the inner surface of tube so as to function also as a reinforcing member which enhances the tube's resistance to pressure.

The prior art tubes which are seam-welded and reinforced are not necessarily easy to manufacture. Particularly, it is considerably difficult to insert the inner fin member the entire length of each tube which is extremely thin, whereby productivity is lowered raising the manufacturing cost.

OBJECTS AND SUMMARY OF THE INVENTION

Therefore a first object of the present invention which was made to resolve the aforementioned problems is to provide a tube for heat exchangers which are particularly suited for use as condensers, the tube being not only of a height or thickness reduced to such a degree as to ensure an improved heat transfer efficiency, but also being of a higher pressure resistance and easy to manufacture.

A second object of the invention is to provide a method to manufacture a tube for heat exchangers, which tube has such features as just described in respect of the first object.

Other objects will become apparent from the preferred embodiments described below.

From an aspect of the invention, the first object is achieved with a tube for heat exchangers which comprises a pair of plane walls spaced a predetermined distance from one another, the plane walls respectively having one lateral end integrally connected to each other by a U-shaped bent portion, the plane walls further having their other lateral ends which abut against and are tightly secured to one another to define a flat configuration of the tube, one or more curved lugs integral with and protruding inwardly from an inner surface of each plane wall, the curved lugs respectively having innermost tops, with the innermost tops of the curved lugs protruding from one plane wall bearing against and integral with the inner surface of the other plane wall or with the innermost tops of the other curved lugs protruding from said other plane wall.

From another aspect of the invention, the first object is achieved with a tube for heat exchangers which comprises a pair of preformed plates spaced a predetermined distance from one another, the preformed plates being tightly secured to one another at both lateral ends to define a flat configuration of the tube, one or more curved lugs integral with and protruding inwardly from an inner surface of each preformed plate, and the curved lugs respectively having innermost tops, with the innermost tops of the curved lugs protruding from one preformed plate bearing against and integral with the inner surface of the other preformed plate or with the innermost tops of the other curved lugs protruding from said other preformed plate.

From a further aspect of the invention, the second object is accomplished by a method for manufacturing a tube for heat exchangers, the method comprising the steps of: preparing a strip of a predetermined width; forming one or more curved lugs integrally protruding from inner surfaces of both lateral sides of a middle portion of the strip; bending the strip, having the curved lugs, at the middle portion into a U-shape in cross section to form plane walls corresponding to the lateral sides; then abutting lateral extremities of the plane walls one on another; welding the lateral extremities one to another to form an ellipse in cross section such that innermost tops of the curved lugs of one plane wall engage the inner surface of the other plane wall or with opposite innermost tops of the other curved lugs of said other plane wall; and then soldering the innermost tops to the inner surface or to the opposite innermost tops with which they are engaged.

From a still further aspect, the second object is achieved by a method for manufacturing a tube for heat exchangers, the method comprising the steps of: preparing a strip of predetermined width; forming one or more curved lugs integrally protruding from inner surfaces of both lateral sides of middle portion of strip; bending the strip, having the curved lugs, at the middle portion into a U-shape in cross section to form plane walls corresponding to the lateral sides; then abutting lateral extremities of the plane walls one on another to form an ellipse in cross section such that innermost tops of the curved lugs of one plane wall engage with the inner surface of the other plane wall or with opposite innermost tops of the other curved lugs of said other plane wall; and then soldering in one operation the lateral extremities abutting one on another as well as the innermost tops to the inner surface or to the opposite innermost tops with which they are engaging.

Each curved lug may be a tightly folded gather extending along the tube. This type of the curved lug may alternately protrude from one and the other plane walls of the tube so as to divide an internal space thereof into a plurality of separate coolant paths.

Alternatively, each curved lug may be a dimpled recess also formed integral with either plane wall. A plurality of this further type of the curved lugs are distributed over the inner surfaces of either or both plane walls so as to form a zigzag coolant path within the tube.

BRIEF DESCRIPTION OF THE DRAWINGS

In the drawings illustrating the preferred embodiments of the present invention.

THE PREFERRED EMBODIMENTS

First Embodiment

Figure 1:
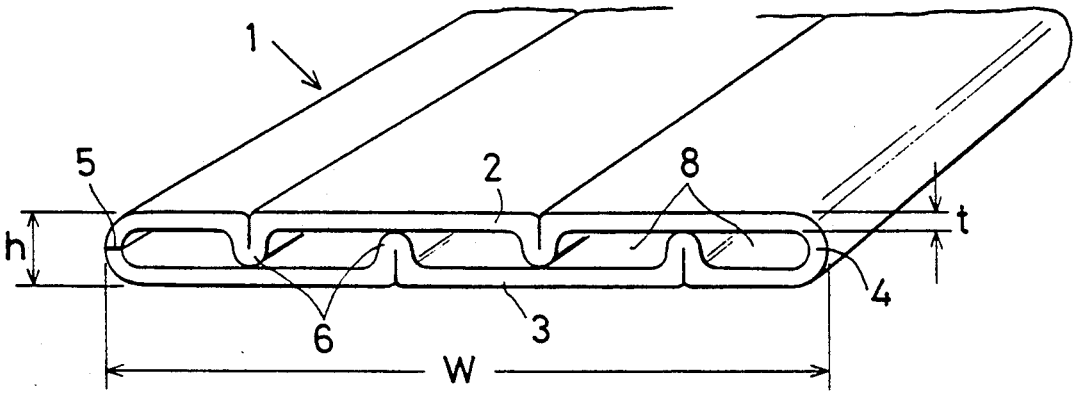
FIG. 1 a perspective view of a tube provided according to a first embodiment.

In a first embodiment shown in FIGS. 1 and 2, a tube 1 for heat exchangers comprises a pair of upper and lower plane walls 2 and 3 disposed facing one another and spaced a predetermined distance, for example 0.8 mm, from each other. The plane walls 2 and 3 respectively have lateral ends integrally connected to each other by a U-shaped bent portion 4. The plane walls further have their other lateral ends which abut against and are tightly welded one to another at a point 5, thereby forming a flat seam-welded pipe of an ellipse-like shape in its cross section. The tube 1 further comprises two curved lugs 6 integral with and protruding inwardly from an inner surface of each plane wall 2 and 3 so that two lugs 6 of one plane wall 2 and two other lugs 6 of the other plane wall 3 alternate in a transverse direction thereof. Each curved lug 6 is formed by inwardly recessing a portion of the plane wall 2 or 3 into a V-shape and by subsequently pressing two opposing legs of the "V" into close contact with each other, thereby forming a double-ply wall portion. The curved lugs thus extend longitudinally of the tube 1. An innermost top of each curved lug 6 protruding from one plane wall 2 or 3 bears against the opposite inner surface of the other plane wall 3 or 2. The innermost tops are soldered to said opposite inner surface, while the two contacting V-legs of said double-ply wall portion are also soldered integral with each other. Such a soldering of the abutting or contacting portions is effected by making use of soldering agent layers of a both-sided aluminum brazing sheet which is used to form the tube. Therefore, the soldering may be performed at the same time as fins 34 and tubes 1 are soldered together and tubes 1 and headers 31 and 32 are soldered together when assembling the heat exchanger.

As a result, the curved lugs 6 function as partitions which divide an internal space of the soldered tube 1 into a plurality of separate coolant paths 8 arranged in the transverse direction of tube 1.

Wall thickness "t" of the tube 1 may be 0.15 to 0.5 mm, and more preferably 0.4 mm as an example. Tube width "w" may be 12 to 20 mm, and more preferably 16 mm as an example, with tube height "h" designed to be 1.2 to 2.0 mm, more preferably to be for example 1.6 mm.

Figure 2A:
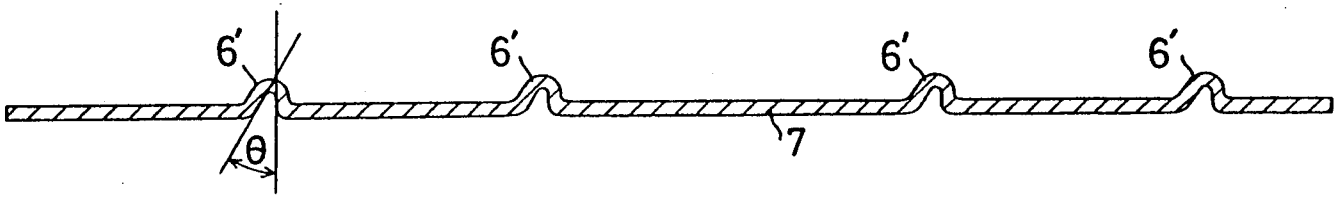
FIGS. 2*a* to 2*d* are cross-sectional views showing a process for manufacturing the tube in the first embodiment.
Figure 2B:
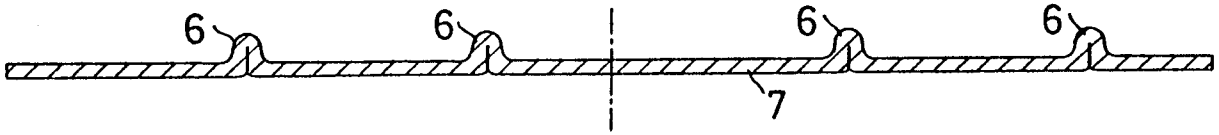

In order to manufacture the tube 1, a strip 7 of the aluminum brazing sheet of a predetermined width is prepared to be processed as shown in FIG. 2*b*. One or more curved lugs 6 are formed by folding longitudinal portions of the strip to protrude in the same direction from surfaces of right and left lateral sides of a transverse middle portion of the strip 7, which portion is bent later. As shown in FIG. 2*a*, beaded portions 6' are first formed in an "italic-V" shape which has an upright leg perpendicular to the strip surface and an oblique leg inclined toward the upright leg by an angle $\theta$ of about 30°. As the next step, each beaded portion 6' is subjected to a trimming operation wherein the legs thereof are gathered into close contact with each other, thereby producing a desired neat shape of the curved lugs 6 as illustrated in FIG. 2*b*.

Figure 2C:
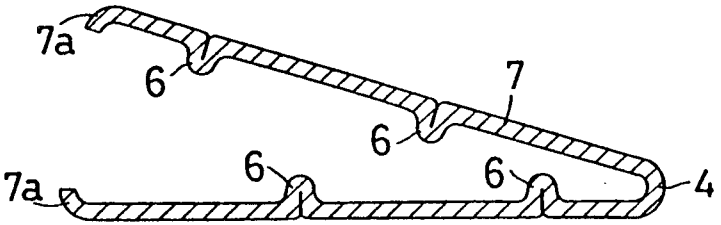
Figure 2D:
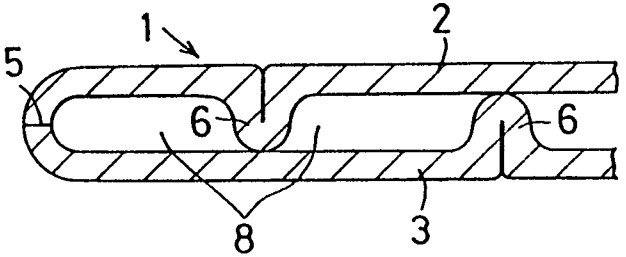

Subsequently, the strip 7 comprising such curved lugs 6 is bent at its transverse middle portion into a U-shape which has a predetermined radius of curvature, as shown in FIG. 2*c*. Portions adjacent to lateral extremities 7*a* and 7*a* are slightly bent in opposite directions so as to abut one on another, with the abutted portions being seam-welded as denoted by the reference numeral 5 in FIG. 2*d*. FIG. 2*d* shows the thus manufactured flat tube 1 in part and on an enlarged scale, the tube having a predetermined dimension and being of an ellipse-shape as a whole in cross section.

Figure 3:
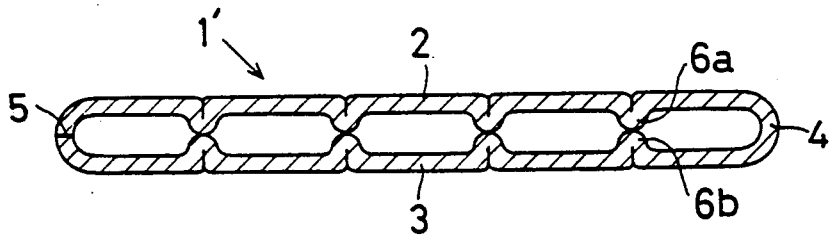
FIG. 3 shows a modified tube in the first embodiment.

FIG. 3 illustrates a modified tube 1' comprising curved lugs 6*a* and 6*b* which are of a smaller height and protrude from opposite corresponding portions of the upper and lower plane walls 2 and 3, respectively. Innermost tops of the opposite curved lugs 6*a* and 6*b* abut one on another and are soldered there to be integral with each other. Other features as well as the manufacturing method are the same as or similar to the tube 1 in the first embodiment.

Figure 4:
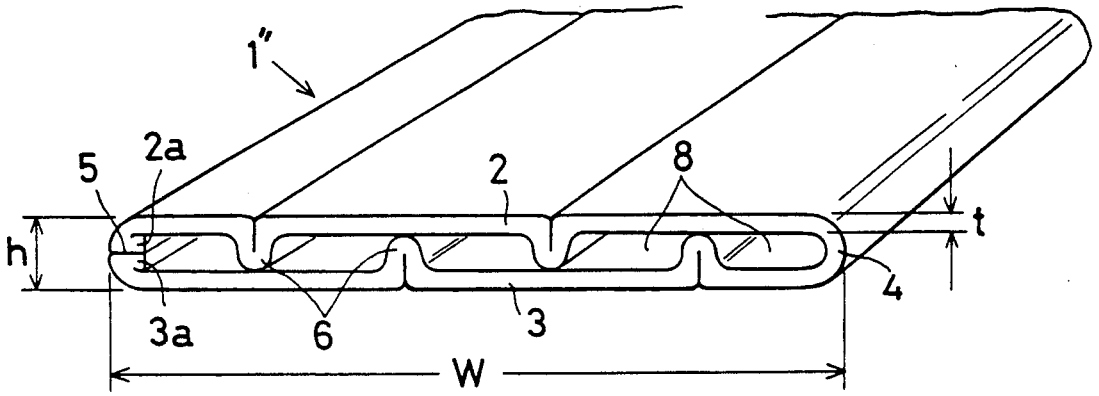
FIG. 4 is a perspective view of a further modified tube in the first embodiment.

FIG. 4 shows a further modified tube 1'' which comprises the upper and lower strip-like plane walls 2 and 3 spaced apart, for example, 0.8 mm. The plane walls have lateral ends integrally connected by the U-shaped bent portion 4, with other lateral ends being soldered one to another to thereby form a flat tube of an ellipse-shape in cross section. The other lateral ends of the walls 2 and 3 have been folded down parallel and inwardly to form creased edges 2*a* and 3*a* which are of a predetermined width, before the creased edges 2*a* and 3*a* are engaged with and soldered to each other at the region 5. Such a binding structure is more advantageous than the simple abutting and soldering of lateral ends as in the other cases already described, because the binding operation is easier and the soldering process in an oven becomes sure and smooth. The binding of lateral ends may be effected either by the soldering or the seam-welding method. It is preferable to solder said lateral ends at the same time together with other members of heat exchanger in a one-shot operation, wherein the soldering agent layers of two-sided aluminum brazing sheet may be utilized advantageously. In the one-shot operation, the soldering of fins 34 to tubes 1 as well as the soldering thereof to headers 31 and 32 are carried out simultaneously as the lateral ends of tube walls are soldered.

Other features of this modified tube and details of its manufacture are the same as or similar to the tube 1 in the first embodiment.

Figure 5:
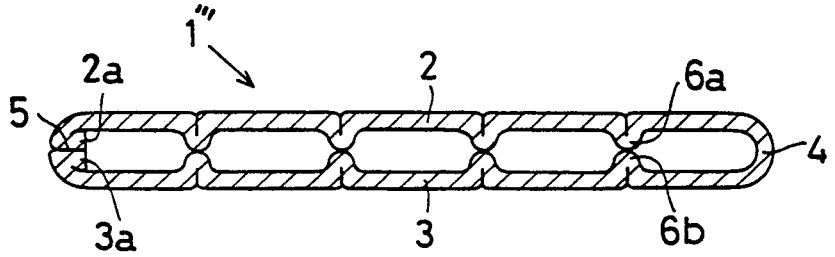
FIG. 5 is a cross-sectional view of a still further modified tube.

FIG. 5 shows a still further modified tube 1''' comprising curved lugs 6*a* and 6*b* which are of a smaller height and protrude from opposite corresponding portions of upper and lower plane walls 2 and 3, respectively. Innermost tops of the opposite curved lugs 6*a* and 6*b* abut one on another and are soldered there to be integral with each other. Other features of this modified tube and details of its manufacture are the same as or similar to the tube shown in FIG. 4.

Second Embodiment

Figure 6:
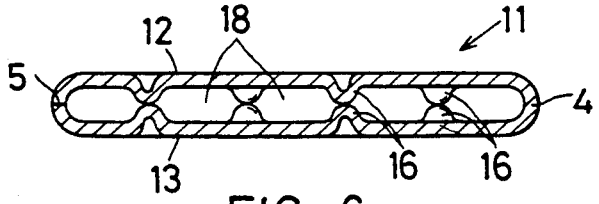
FIG. 6 is a cross-sectional view of a tube provided according to a second embodiment of the invention.
Figure 7:
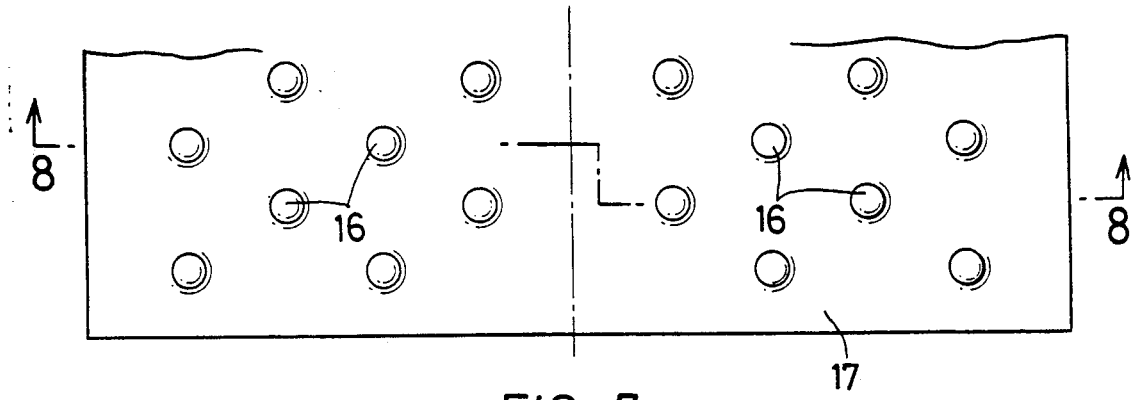
FIG. 7 is a plan view of a strip which is being processed to form the tube in the second embodiment.
Figure 8:
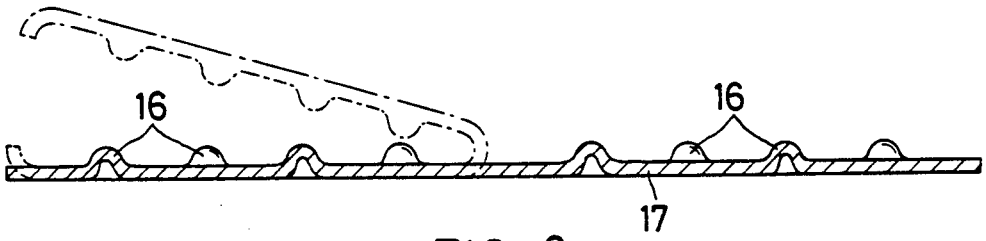
FIG. 8 is a cross-sectional view taken along the line 8—8 in FIG. 7.

In a second embodiment shown in FIGS. 6 to 8, a tube 11 comprises curved lugs 16 which protrude inwardly from separate portions of upper and lower plane walls 12 and 13. Those lugs 16 are provided by recessing the portions of walls 12 and 13 inwardly into semi-spherical or U-shaped dimple-like shape in cross section. Thus, a plurality of the dimple-like curved lugs 16 are distributed over each plane wall. Respective innermost tops of the lugs 16 on upper wall correspond to and engage with respective innermost tops of the lugs 16 on lower wall so that they are soldered there to be integral with each other. An inner space of the tube 11 becomes a single coolant path 18 of a stray or zigzag pattern due to such scattered dimple-like curved lugs 16. The coolant flowing through this path 18 in the tube 11 will be stirred by the curved lugs 16 to thereby facilitate the exchange of heat.

Details of other structural features of this tube 11 are the same as those of the first embodiment in FIGS. 1 and 2, and therefore will not be repeated here.

Similarly to the case shown in FIGS. 1 and 2, the tube 11 is made from a strip 17 of aluminum brazing sheet, which strip 17 is of a predetermined width as shown in FIGS. 7 and 8. The dimple-like curved lugs 16 are formed at predetermined points of the strip before it is folded into U-shape in cross section at its transverse middle portion, as shown by the phantom line in FIG. 8. After that, the strip's lateral ends abutting one on another are seam-welded as shown by the numeral 5 so as to define a flat depressed tube.

Also in a modification of the second embodiment, the curved lugs 16 on one of the plane walls 12 may also be arranged at positions different from those on the other plane wall 13, in a manner similar to that described hereinbefore. The innermost tops of those lugs engage with the opposite plane wall and are soldered thereto.

Third Embodiment

Figure 9:
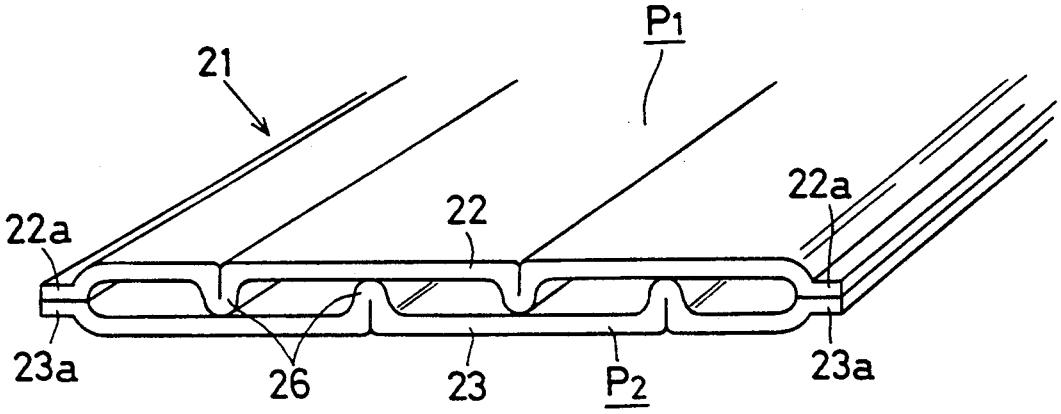
FIG. 9 is a perspective view of a tube provided according to a third embodiment of the invention.
Figure 10:
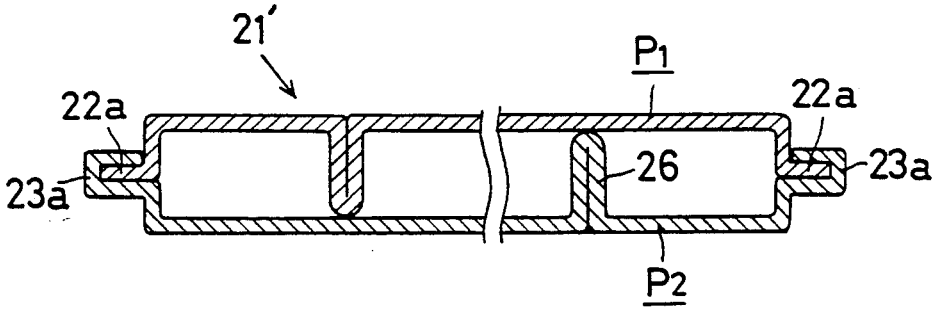
FIG. 10 is a cross-sectional view of a modified tube in the third embodiment.

In a third embodiment shown in FIG. 9, a tube 21 is composed of two preformed plates $P_1$ and $P_2$. Curved lugs 26 protruding inwardly and longitudinally of one plate $P_1$ and other ones 26 of the other plate $P_2$ alternate in the transverse direction thereof. The preformed plates are arranged such that their curved lugs are disposed inwardly with lateral ends of said plates, i.e., plane walls, facing one another to be soldered and united. The number of curved lugs 26 is two for each preformed plate.

Both lateral ends of each preformed plate $P_1$ or $P_2$ are L-shaped bent portions 22*a* or 23*a* which abut each other and are soldered to be integral with one another. They may not be soldered but welded, if necessary. Other structural features of this tube 21 are the same as those in the first and second embodiments, therefore description thereof is omitted here.

The third embodiment may also be modified such that the curved lugs 26 on the upper plane wall 22 are arranged offset to those on the lower plane wall 23, wherein innermost tops of those lugs are engaged with and soldered to each other.

To facilitate the assembling of tube 21, its plates $P_1$ and $P_2$ are preferably set temporarily or preliminarily prior to the soldering thereof. As an example, the edges of L-shaped bent portions 23*a* of lower plate $P_2$ may be bent again upwards and inwards, along the full length of tube 21', into a U-shape. Each of the U-shaped edges tightly embraces the corresponding bent portion 22*a* of upper plate 22*a*. In detail, the upper and lower L-shaped portions 22*a* and 22*b* are formed at first so that the upper one can be slidingly inserted into the lower one.

Figure 11A:
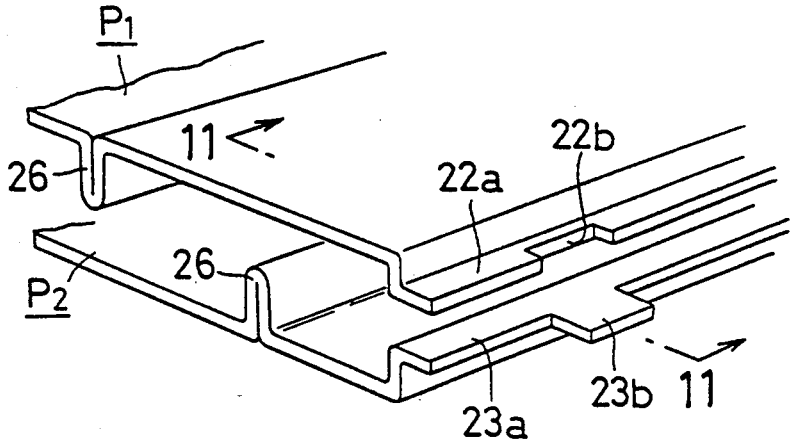
FIG. 11*a* is a perspective view showing a further modified tube, with its preformed plates being separated.
Figure 11B:
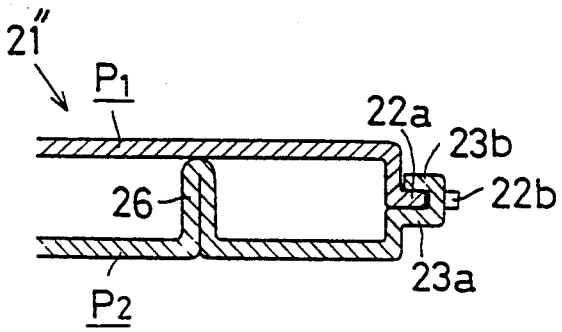
FIG. 11*b* is a cross-sectional view taken along the line 11—11 in FIG. 11*a* and showing the further modified tube, with its preformed plates being integrated.
Figure 12A:
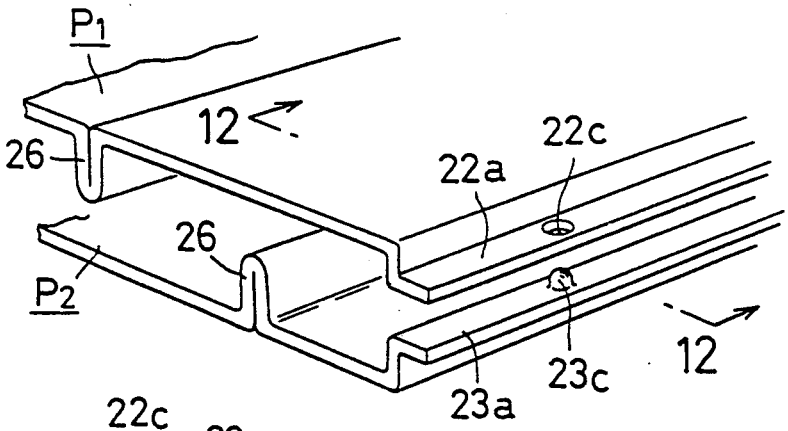
FIG. 12*a* is a perspective view showing a still further modified tube, with its preformed plates being separated.
Figure 12B:
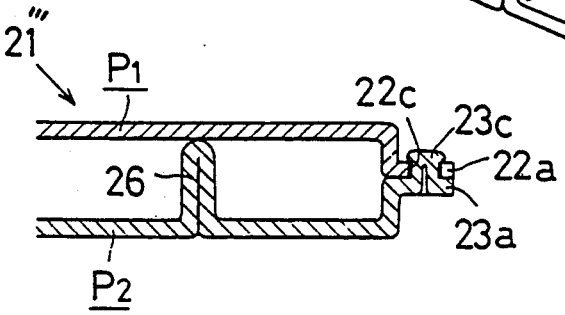
FIG. 12*b* is a cross-sectional view taken along the line 12—12 in FIG. 12*a* and showing the still further modified tube, with its preformed plates being integrated.
Figure 13:
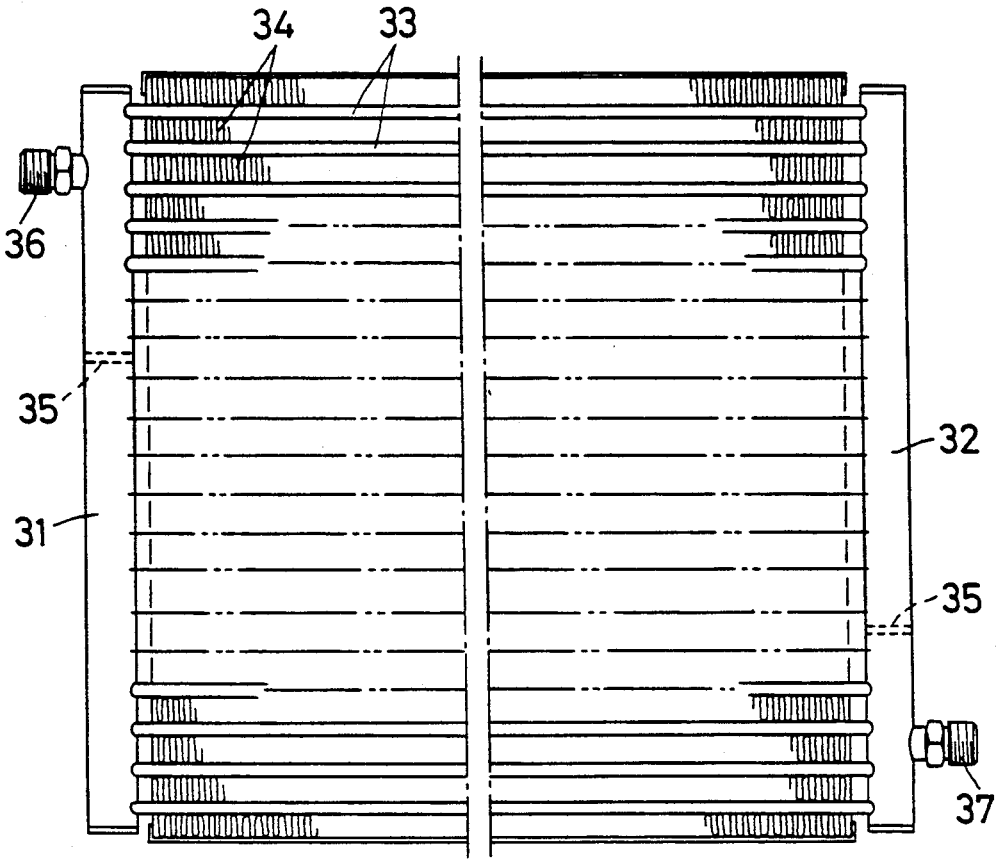
FIG. 13 is a front elevation of a heat exchanger in which the tubes of the invention are incorporated.
Figure 14:
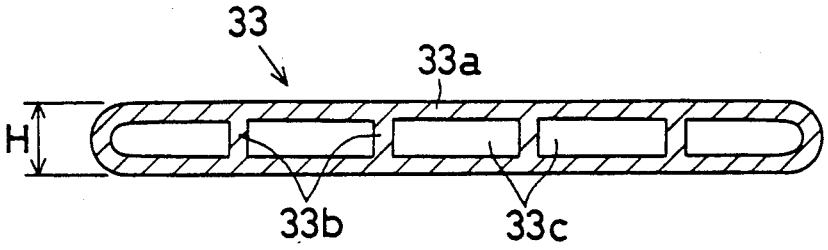
FIG. 14 is a cross-sectional view of a prior art flat tube which is manufactured by the extrusion method.

FIG. 11*a* illustrates a modified means for the preliminary setting, wherein some tongues 23*b* are formed to protrude from the outer edge of each L-shaped bent portion 23*a* of the lower plate $P_2$. Corresponding to the tongues, cutouts 22*b* are formed on each L-shaped bent portion 22*a* of the upper plate $P_1$. With the upper plate $P_1$ overlying the lower one $P_2$, the tongues 23*b* are bent towards the cutouts 22*b* and folded down onto the edges of L-shaped portion, thereby binding the plates to form a tube 21'' as shown in FIG. 11*b*. FIG. 12*a* illustrates another modification in which small round ribs 23*c* protrude upwardly of the L-shaped bent portions 23*a* of lower plate $P_2$. Respective holes 22*c* which are formed through the bent portions 22*a* of upper plate $P_1$ correspond to the respective ribs 23*c*. Tube 21''' is assembled as shown in FIG. 12*b*, by placing the upper plate $P_1$ upon the lower one $P_2$ and then distressing the tops of ribs 23*c* projecting through the holes 22*c* so as to secure the ribs therein.

Although the curved lugs 26 extend longitudinally of the tube 21, 21', 21'', or 21''', those lugs 16 may be dimple-like protrusions which are formed by recessing the portions of plane walls 22 and 23 inwardly into semispherical shape or U-shape in cross section. In such a case, a plurality of the dimple-like protrusions are distributed over each plane wall. Innermost tops of the upper and lower corresponding protrusions are engaged and soldered integral with each other. Thus, an inner space of the tube becomes a single coolant path of a stray pattern due to such scattered dimple-like protrusions. The coolant flowing through this path will be stirred and assisted by the protrusions to enhance the heat exchange.

Further, the bent portions of lateral ends may not be bent outwards as in the third embodiment but alternatively be bent inwards.

It will now be apparent that, because either a single thin strip is folded or two thin preformed plates are coupled to form a flat tube for heat exchangers, the tube comprises sufficiently thin walls that its height is minimized, rendering it to be of minimal thickness.

It will be understood also that the curved lugs, which protrude from the upper and lower plane walls so as to be engaged and soldered to one another or to the opposite inner surface of the wall, can function as the reinforcing members of the tube, thereby improving its compressive strength and its resistance to internal pressure. Thus, the tube provided for condensers according to the invention is by no means inferior to the flat extruded tube of prior art.

To manufacture the tube of the invention, it is needed merely to apply the conventional integrating technology to the single strip or two plates on which the predetermined curved lugs have been formed. Therefore, the manufacturing process permits the production of tubes at a higher productivity and lower manufacturing cost.

Further, in a case wherein the curved lugs extend longitudinally of the tube, its pressure resistance and its strength are increased advantageously. In another case wherein the curved lugs are shaped as the dimples, the coolant is so effectively stirred, while flowing through the tubes' internal paths in the tubes, that their heat exchange efficiency is improved to a remarkable degree.

What is claimed is:

1. A tube for heat exchangers, the tube comprising:

a pair of plane walls spaced a predetermined distance from one another;

each plane wall having a lateral end integrally connected to the lateral end of the other wall by a U-shaped bent portion;

each plane wall having an opposite lateral end which abuts against and is tightly secured to the opposite lateral end of the other wall to define a flat configuration of the tube;

each plane wall including at least one curved lug, said lug being a folded, two ply portion of the plane wall, said lug and the remaining portion of the plane wall being a one-piece, integral unit;

the curved lug of one plane wall protruding towards the other plane wall and having an innermost top bearing against and being brazed to the inner surface of the other plane wall;

said tube being made from a brazing sheet comprising a core material having both sides coated with a brazing layer.

2. A tube according to claim 1, wherein the curved lugs divide an internal space between the end walls into a plurality of separate coolant paths.

3. A tube according to claim 1, wherein the other lateral ends of the plane walls comprise creased edges which are abutted in parallel with and soldered integral with each other.

4. A tube according to claim 3, wherein the creased edges extend inwardly of the tube.

5. A tube for heat exchangers, the tube comprising:

a pair of preformed plates spaced a predetermined distance from one another;

the preformed plates being tightly secured to one another at both lateral ends to define a flat configuration of the tube;

one or more curved lugs protruding inwardly from an inner surface of each preformed plate, said lugs being folded, two-ply portions of the plates, the lugs and the remaining portion of each plate being a one-piece, integral unit; and the curved lugs respectively having innermost tops, wherein the innermost tops of the curved lugs protruding from one preformed plate bear against and are fixedly secured to the inner surface of the other preformed plate or to the innermost tops of the other curved lugs protruding from said other preformed plate.

6. A tube according to claim 5, wherein both lateral ends of the preformed plates comprise L-shaped bent portions which are abutted in parallel with and soldered integral with each other.

7. A tube according to claim 6, wherein the L-shaped bent portions protrude outwards.

8. A tube according to claim 7, wherein the L-shaped bent portions of one preformed plate comprise U-shaped ends in which the other L-shaped bent portions of the other preformed plate are embraced, respectively.

9. A tube according to claim 7, wherein each L-shaped bent portion of one preformed plate comprises a plurality of tongues which protrude outwards to be received respectively in cutouts formed through each L-shaped bent portion of the other preformed plate, with the tongues being folded down inwards to secure the the former L-shaped portion to the latter one.

10. A tube according to claim 7, wherein each L-shaped bent portion of one preformed plate comprise ribs which protrude towards the other preformed plate so as to penetrate holes formed through the other L-shaped bent portions of the other preformed plate, wherein tops of the ribs are distressed to retain the ribs in the holes, respectively.

11. A tube for heat exchangers, the tube comprising:

a pair of plane walls spaced a predetermined distance from one another;

each plane wall having a lateral end integrally connected to the lateral end of the other wall by a U-shaped bent portion;

each plane wall having an opposite lateral end fixedly secured to the opposite lateral end of the other wall to define a flat configuration for the tube;

at least one curved lug in each plane wall, said lug being an integral portion of the plane wall;

the curved lug of one plane wall protruding toward the other plane wall and having an innermost top which bears against and is secured to the inner surface of the other plane wall or to the innermost top of a curved lug of the other plane wall;

the opposite lateral ends including creased edges which abut one another and are fixedly secured to each other, said creased edges extending in parallel inwardly of the tube.

12. A tube for heat exchangers, the tube comprising:

a pair of preformed plates spaced a predetermined distance from one another;

the preformed plates being tightly secured to one another at both lateral ends to define a flat configuration for the tube;

one or more curved integral with and protruding inwardly from an inner surface of each preformed plate;

the curved lugs respectively having innermost tops, wherein the innermost tops of the curved lugs protruding from one preformed plate bear against and are secured to the inner surface of the other preformed plate or to the innermost tops of the other curved lugs protruding from said other preformed plate;

both lateral ends of the preformed plates including L-shaped bent portions which abut in parallel with one another and are fixedly secured together, said L-shaped bent portions protrude outwardly of the tube;

the bent portion of one preformed plate including at least one rib which protrudes toward the other preformed plate to penetrate a hole formed through the other L-shaped bent portion of the other preformed plate, wherein the top of the rib is distressed to retain the rib in the hole.

* * * * *

UNITED STATES PATENT AND TRADEMARK OFFICE
CERTIFICATE OF CORRECTION

PATENT NO. : 5,186,250

DATED : February 16, 1993

INVENTOR(S) : Wataru Ouchi et al.

It is certified that error appears in the above-identified patent and that said Letters Patent is hereby corrected as shown below:

On the title page, item [30]:
"Foreign Application Priority Data", delete "2-1222289" and substitute therefor -- 2-122289 --.

In the abstract, line 12, delete "curve" and substitute therefor -- curved --.

In the abstract, line 17, delete "Th" and substitute therefor -- The --.

In claim 12, line 7, (column 10, line 13) after "curved" insert -- lugs --.

Signed and Sealed this

Twenty-seventh Day of September, 1994

*Attest:*

*Attesting Officer*

Bruce Lehman

BRUCE LEHMAN

*Commissioner of Patents and Trademarks*